US010960906B2

(12) United States Patent
Skowronek et al.

(10) Patent No.: US 10,960,906 B2
(45) Date of Patent: Mar. 30, 2021

(54) ENERGY ABSORBING FASTENER AND PIVOT ANCHOR AND CAR

(71) Applicant: DELLNER COUPLERS AB, Falun (SE)

(72) Inventors: Jacek Skowronek, Gdynia (PL); Anders Westman, Falun (SE)

(73) Assignee: Dellner Couplers AB, Falun (SE)

( * ) Notice: Subject to any disclaimer, the term of this patent is extended or adjusted under 35 U.S.C. 154(b) by 239 days.

(21) Appl. No.: 15/771,680

(22) PCT Filed: Oct. 25, 2016

(86) PCT No.: PCT/EP2016/001769
§ 371 (c)(1),
(2) Date: Apr. 27, 2018

(87) PCT Pub. No.: WO2017/071802
PCT Pub. Date: May 4, 2017

(65) Prior Publication Data

US 2019/0061789 A1 Feb. 28, 2019

(30) Foreign Application Priority Data

Oct. 30, 2015 (EP) ..... 15003106

(51) Int. Cl.
*B61G 9/22* (2006.01)
*B61G 9/10* (2006.01)
(Continued)

(52) U.S. Cl.
CPC ..... *B61G 9/22* (2013.01); *B61G 5/02* (2013.01); *B61G 9/04* (2013.01); *B61G 9/10* (2013.01)

(58) Field of Classification Search
CPC ... B61G 5/00; B61G 5/02; B61G 7/00; B61G 7/10; B61G 9/00; B61G 9/02; B61G 9/04;
(Continued)

(56) References Cited

U.S. PATENT DOCUMENTS 3,838,778 A 10/1974 Appleton
7,410,069 B2 8/2008 Hogbring et al.
(Continued)

FOREIGN PATENT DOCUMENTS

CN 101142115 A 3/2008
CN 101674969 A 3/2010
(Continued)

*Primary Examiner* — Robert J McCarry, Jr.
(74) *Attorney, Agent, or Firm* — Howard IP Law Group, PC

(57) ABSTRACT

The invention relates to an energy absorbing fastener suitable for connecting a part of a coupler or pivot to a car of a multi-car vehicle, wherein a fastener having a head and an end is provided, the end being suitable to be connected to an element of the coupler or the pivot, a deformation tube surrounding the fastener, whereby the deformation tube has a first end, whereby the head of the fastener rests against the first end or rests against an element that rests against the first end, and whereby the deformation tube has a second end suitable to rest against a surface of the car or a connection plate suitable to be connected to the car.

20 Claims, 2 Drawing Sheets

(51) Int. Cl.
*B61G 5/02* (2006.01)
*B61G 9/04* (2006.01)

(58) Field of Classification Search
CPC . B61G 9/20; B61G 9/22; B61G 11/00; B61G 11/08; B61G 11/10; B61G 11/14
See application file for complete search history.

(56) References Cited

U.S. PATENT DOCUMENTS

| | | | | |
|---|---|---|---|---|
| 8,297,419 | B2 | 10/2012 | Gansweidt | |
| 8,418,862 | B2 | 4/2013 | Liu et al. | |
| 8,714,377 | B2 | 5/2014 | Peckham | |
| 8,967,404 | B2 | 3/2015 | Sagawa et al. | |
| 2009/0008963 | A1* | 1/2009 | Lindner ..... | B61G 11/16<br>296/187.03 |
| 2012/0199545 | A1 | 8/2012 | Peckham | |

FOREIGN PATENT DOCUMENTS

| | | | |
|---|---|---|---|
| CN | 101698414 | A | 4/2010 |
| CN | 101835669 | A | 9/2010 |
| CN | 103237710 | A | 8/2013 |
| CN | 103402850 | A | 11/2013 |
| EP | 1905661 | A1 | 4/2008 |
| RU | 2 359 854 | C2 | 2/2008 |
| RU | 2 475 392 | C1 | 2/2013 |
| WO | 2005023619 | A1 | 3/2005 |
| WO | WO2005/023618 | A1 | 3/2005 |

* cited by examiner

ENERGY ABSORBING FASTENER AND PIVOT ANCHOR AND CAR

TECHNICAL FIELD OF THE INVENTION

The invention relates to an energy absorbing fastener suitable for connecting a part of a coupler or a pivot to a car of a multi-car vehicle. The invention also relates to a pivot anchor for a car of a multi-car vehicle. The invention also relates to a car of a multi-car vehicle and also to a method of attaching a pivot anchor to a car.

BACKGROUND OF THE INVENTION

Multi-car vehicles are known in different designs and in different forms of adaptation for uses. Multi-car vehicles, for example, railway-bound trains (street cars and subway-trains also being considered as such trains) are known and are known for the purpose of transporting passengers as well as transporting goods. Further types of multi-car vehicles can be magnetic railway trains or can be busses (road buses as well as buses traveling on fixed tracks). A car of a multi-car vehicle can be a self-supporting car, whereby the car has sufficient wheels that are placed at sufficient locations such that the car can stand by itself without being supported by other cars, for example a three-wheeled car, a four wheeled car or a car with even more wheels placed suitable locations. A car of a multi-car vehicle can also be of the non-self-supporting type, whereby the car has no wheels or only wheels provided in such number or arranged at such a place that the car cannot stand by itself, but is vertically supported by at least one neighboring car.

To form the multi-car vehicles, the individual cars of the vehicle are connected to one another by means of a connecting device. The connecting devices can be provided for different types of purposes. In multi-car vehicles where only one or only several of the total of cars is driven, the connecting devices are provided so that a driven car can drive a non-driven car and thus ensure that the complete vehicle travels with the same speed.

Connecting devices are also distinguished between those connecting devices that allow for an easy decoupling of the cars, whereby easy decoupling is understood to be accomplished within a couple of minutes, or for what is called "semi-permanent" coupling of the cars, for which decoupling of the cars takes efforts and usually involves the vehicle to have been transported to a specific work shop. Trains, for example, can have coupler-heads as part of their connecting devices. These coupler-heads can, for example, be so called "automatic couplers" that allow decoupling within minutes.

From WO 2005/023618 A1 a collision protection in a coupling for rail-mounted vehicles of the type that comprises a coupling element in which two parts translationally moveable in relation to each other are included, is known.

In the known collision protection at least one energy-extinction or energy-absorbing element of deformable character is arranged. In the collision protection a deformable tube is shown for example in FIGS. 2, 3 and 10. The deformable tube will be deformed by a cross piece that by way of four screws or bolts is held at a front plate 11. It is described on page 7, lines 4 to 14 of page 7 of WO 2005/023618 A1 that in the area between the male thread and head of the individual screw, the shaft of the screw is somewhat weakened via a waist, the diameter of which decides the strength of the screw. By endowing the waist a suitable diameter, it may be predetermined at which stress the screw should brake. If the link device should be exposed to extreme, axial impulsive forces of the type that arise in connection with collisions and alike, accordingly the link head can be detached from the frame by the screws breaking. In relation to FIG. 6 it is described that the deformable tube has a seating at its rear end and has a washer 40 with a nut 41 being welded in the seating. The mounting of the deformation tube is carried out by means of a bolt that is provided with a head, the male thread of the bolt is screwed to the female thread of the nut attached to the washer. The head of the bolt is tightened against a stopping element in the form of an additional washer, which is pressed against a shoulder. Between the washers, which serve as stopping elements, a spacer member extends, the length of which decides the tightening force by which the conical end portion of the tube is fastened in the mouth or the seating in the back piece.

In the design known from WO 2005/023618 the cross piece has no contact at all with the deformation tubes in the normal driving conditions. However, if a collision would occur and the cars or the vehicle units are applied extreme impulsive forces, which aim to propagate through a train unit, the collision protection is activated. This takes place by the screws breaking, whereby the link head is detached so that the same and the back piece may move towards each other. In doing so, the cross piece first impinges on the central tube and shortly afterwards the two thinner side tubes, wherein all tubes will be pressed into the appurtenant bore in the back piece up to a point where the cross piece is stopped against the front surface of the back piece. When the individual tube is pressed into the appurtenant bore, the same will be deformed successfully by being compressed or pressed together in the radial direction while the outer diameter of the tube is reduced to the same inner diameter as the front section in the bore.

BRIEF SUMMARY OF THE INVENTION

Based on this background, it is an object of the invention to suggest an energy absorbing fastener suitable for connecting a part of a coupler or a pivot to a car of a multi-car vehicle and to suggest an improved pivot anchor for a car of a multi-car vehicle.

This problem is solved by the energy absorbing fastener according to claim 1 and the pivot anchor according to claim 5. Preferred embodiments are described in the subordinate claims and the description following here below.

The energy absorbing fastener that is suitable for connecting a part of a coupler or a pivot to a car of a multi-car vehicle has a fastener having a head and an end, the end being suitable to be connected to an element of the coupler or the pivot. According to the invention, a deformation tube is provided that surrounds the fastener. The deformation tube has a first end, whereby the head of the fastener rests against the first end or rests against an element that rests against the first end. The deformation tube has a second end that is suitable to rest against a surface of the car or a connection plate suitable to be connected to the car.

The invention is based on the idea that fasteners with a head and an end as they are often used to connect a part of a coupler or a pivot to a car of a multi-car vehicle can be used as deforming elements for a deformation tube. In a collision, the fastener being connected to an element of the coupler or the pivot will tend to move together with the coupler or the pivot in the direction that the coupler or the pivot will travel during the collision. The deformation tube that surrounds the fastener according to the invention is sandwiched between the head of the fastener on the one side and a surface of the car or a connection plate suitable to be connected to the car. During a collision, especially a collision where axial forces pointing along the longitudinal axis of the multi-car vehicle arise, the coupler or the pivot connected to the car of the multi-car vehicle tends to move relative to the car. Hence the head of the fastener on the first end of the deformation tube tends to travel relative to the second end of the deformation tube that is intended to rest against a surface of the car or connection plate suitable to be connected to the car. This relative movement will tend pull the head of the fastener that in the normal driving condition rests against the first end of the deformation tube into the deformation tube or will tend to squash the deformation tube between the head of the fastener and the car or the connection plate suitable to be attached to the car. In doing so, the deformation tube will be deformed. This deformation of the deformation tube takes up energy, thus helps to reduce the amount of energy being transmitted along a multi-car vehicle in a collision.

Claim 1 of the present application is directed to the energy absorbing fastener itself, which is in its most basic arrangement made up of the fastener and the deformation tube itself. The combination of these two pieces already makes up a unit that can be sold to third parties to be then used by the third parties for connecting a part of a coupler of a pivot to a car of a multi-car vehicle.

The fastener has a head. This is necessary so that the fastener can rest against the first end of the deformation tube that surrounds the fastener. In a preferred embodiment the fastener according to the invention will be used in the flow of force from the coupler or pivot to the car. The fastener will be connected to a part of the coupler or the pivot. As the multi-car vehicle is made to move, for example pushed, or made to slow down, a driving condition will rise, where due to the application of force in that specific driving condition the part of the coupler or the pivot tends to move relative to the car of the multi-car vehicle to which it is fastened by way of the fastener. In this specific embodiment it will be the fastener (or a multitude of like fasteners) that connect the part of the coupler or pivot to the car. Hence, it will be the fasteners, according to the invention, that will prevent the movement of the coupler or pivot relative to the car. Depending on the specific arrangement, in a preferred embodiment, to hold back the coupler or pivot to which the fastener is attached relative to the car to which the fastener attaches the coupler or pivot, the fastener will need to withstand a pulling force that acts along its longitudinal axis, while it is pulled by this longitudinal force against the first end of the deformation tube. The deformation tube needs to be suitable to provide a reaction force to hold the head of the fastener resting against its first end in place during normal driving conditions. In order to provide this reaction force, the deformation tube needs to have a predetermined stiffness depending on the level of forces to be expected during normal driving conditions and depending on the number of fasteners according to the invention that are used and that thus share the overall level of force between each other. In the normal driving condition, the deformation tube is designed to not deform and to hold the head of the fastener resting against its first end away from the surface of the car or the connection plate that the second end of the deformation tube rests against. The purpose of the head of the fastener hence is to allow this interaction between the fastener and the deformation tube and to allow the deformation tube to apply a reaction force to the fastener in order to hold the fastener and thus the part of the coupler or pivot to which the fastener is applied back from moving relative to the car of the multi-car vehicle.

The head of the fastener can be any type of head known from screws. Preferably, the head has a cylindrical shape with a screw hole for an Allen's key (a hexagonal socket).

The fastener preferably has a thread at its end, thereby making it suitable to be connected to an element of the coupler or the pivot, for example a female thread in the respective element of the coupler or pivot. However, depending on the design, other ways of making the fastener suitable to be connected to an element of the coupler or the pivot can be perceived. For example, the fastener itself can have a female thread, while the element of the coupler or the pivot to which the fastener is to be attached has a male thread. The fastener at its end can also have a bayonet joint. The fastener at its end can also have a spline-connection, for example a hole in the fastener, through which a pin is placed that rests against an element of the coupler or the pivot.

The deformation tube surrounds the fastener. In a preferred embodiment, the deformation tube is of ring-shaped cross section. Preferably, the deformation tube has the cross section of a circular or elliptical ring. However, embodiments can be envisaged, where the deformation tube has a rectangular ring-shaped cross section or polygonal ring-shaped cross section. Preferably the deformation tube is of steel or any other material typically used for deformation tubes.

According to the invention, the head of the fastener rests against the first end or rests against an element that rests against the first end. The way of how the head of the fastener rests against the first end depends on the preferred design of the head of the fastener and the shape of the deformation tube. Embodiments are feasible, where the deformation tube has an inner diameter that is only slightly larger than the outer diameter of the main body of the fastener, the main body of the fastener being considered to be the part between the head and the end of the fastener. The inner diameter of the deformation tube being to a certain extend limited regarding how small it can be made by the type of connection chosen for the end of the fastener. Given that the fastener preferably is inserted into the deformation tube during manufacturing of the energy absorbing fastener according to the invention, the inner diameter of the deformation tube preferably is larger than the outer diameter of the male thread provided at the end of the fastener, if a threaded connection is chosen for connecting the fastener to an element of the coupler or the pivot.

In the embodiments where the inner diameter of the deformation tube is only slightly larger than the outer diameter of the main body of the fastener, it can easily be provided to have the head of the fastener rest directly against the end of the deformation tube. The fastener will have a larger outer diameter than the outer diameter of the main body of the fastener. Given that the head thus protrudes over the main body of the fastener, the above described arrangement will allow the fastener to rest directly against the first end of the deformation tube.

However, embodiments are also feasible, where the deformation tube is purposefully made substantially larger in diameter than the diameter of the main body of the fastener. This can be chosen as an embodiment with regard to the amount of energy to be absorbed by the deformation tube. In such an embodiment, a design for the head of the fastener might be chosen that does not protrude over the main body of the fastener sufficiently enough to rest against the first end of the deformation tube. In such an embodiment a further element that itself rests against the first end of the deformation tube might be used, for example a washer. In such an embodiment the head would rest against the further element, while the further element itself rests against the first end of the deformation tube.

The second end of the deformation tube is suitable to rest against a surface of the car or a connection plate suitable to be connected to the car. In a preferred embodiment, the second end of the deformation tube is made suitable to rest against the surface of the car or a connection plate suitable to be connected to the car by way of having a ring-shaped end surface, whereby the end surface lies in one plane. In a preferred embodiment, the plane in which the end surface lies, is perpendicular to the longitudinal axis of the deformation tube.

In a preferred embodiment, the diameter of the deformation tube widens at the first end. It is intended that during a collision, the head of the fastener effects a deformation of the deformation tube, which will lead to an energy adsorption. To enhance the start of the deformation of the deformation tube after a certain force level has been reached, it is advisable to have the deformation tube widen at its first end to have the first end rest in this widening portion. The head of the fastener thus does not need to rest against the very end surface of the deformation tube. The term "the head of the fastener rests against the first end" in the claims and in the description is thus not to be construed in such a sense that the head needs to rest against an end surface of the deformation tube that is provided by the very last part of material of the deformation tube in its longitudinal extend. The term that "the head of the fastener rests against the first end" of the deformation tube is also to be considered to be fulfilled, if the head rests against a surface of the deformation tube provided at the first end of the deformation tube and running at an angle to the longitudinal axis of the deformation tube, because the diameter of the deformation tube is made to widen towards the first end.

In a preferred embodiment a conical ring is inserted into the first end of the deformation tube, whereby the conical ring contacts the inner walls of the deformation tube and the head of the fastener rests against the conical ring. The use of such a conical ring can help the deformation of the deformation tube, especially the widening of the diameter of the deformation tube. It also prevents the head of the fastener to be severed off, while it is being pulled into the deformation tube while widening the inner diameter of the deformation tube at the same time.

The pivot anchor for a car of a multi-car vehicle according to the invention has a pivot pin held in a holder. It also has an elastic deformation element arranged between the holder and a housing, the elastic deformation element being compressed, when the holder is moved towards the housing. According to the invention, the pivot anchor according to the invention has a fastener according to the invention, whereby the fastener is connected to the housing by the end of the fastener being attached to the housing.

In such an arrangement, the elastic deformation provided by the elastic deformation elements can be used to dampen forces during the normal conditions of use of multi-car vehicle. Only if the forces applied reach a certain force level, the deformation of the deformation tube of the fastener according to the invention will be started and will lead to an energy adsorption.

In a preferred embodiment, the fastener has a pre-defined breaking force that will make the fastener break along its longitudinal axis. Once the fastener has broken, the coupler or pivot that is connected to the car or the connection plate is free to move relative to the car or the connection plate. Thus by choosing the level of the pre-defined breaking force, one can influence, up to which force lever the fastener and the deformation tube play a role in the energy dissipation and at which level of force they are taken out of the energy dissipation.

The pivot anchor for a car of a multi-car vehicle is described to have a pivot pin held in a holder and the holder being attached to the housing.

The pivot pin of the pivot anchor will be used to attach further elements of a connecting device to the holder. For example a coupling bar can be connected to the pivot and by way of the pivotable arrangement of the pivot pin within the holder can be allowed to pivot relative to the holder. The bar can be directly connected to a further pin and holder at the other end thereby leading to a direct connection between two cars. The bar can also be made to carry a coupler head at its other end or other means of connection of a connection device that connects two cars of a multi-car vehicle.

The fastener according to the invention is preferably used to fasten the housing to the car or a connection plate suitable to be connected to the car. In a preferred embodiment, the elastic deformation element consists at least of one donut made from an elastic material.

The elastic deformation element is preferably designed to be able to absorb a minimum of 20 kJ of energy in a reversible manner at a force level of 1000 kN. 20 kJ of energy is a level of energy that is generated by the inertia of the cars during normal travel, when a multi-car vehicle accelerates or decelerates or travels over junctions or the like. In a preferred embodiment a material and shape of the deformation tube is chosen such that this deformation tube—or in the embodiments, where a plurality of fasteners are used in parallel—or the sum of deformation tubes used in parallel together with the elastic deformation elements present can withstand a pre-load force of 20 kN, even more preferred of more than 20 kN and even more preferred of 25 kN to 80 kN without deforming.

In a preferred embodiment, a central pin is attached to the holder and the central pin is inserted into the central opening of the donut. This ensures that the donut keeps in place.

In a preferred embodiment, a central plate is arranged on the central pin. At least one donut from a first elastic material is arranged between a front plate of the housing and the central plate. At least one donut of a second elastic material is arranged between the central plate and an end plate of the housing. In a preferred embodiment, the end plate of the housing has a hole, through which the central pin passes. In such an embodiment, if the holder is pushed by axial forces towards the end plate of the housing, the pin will further propagate through the hole provided in the end plate of the housing and the elastic material arranged between the central plate and the end plate of the housing will be deformed. If on the other hand a pulling force is provided to the holder, pulling the holder away from the housing, the central plate will deform the donuts arranged between the front plate of the housing and the central plate.

In a preferred embodiment of the above described embodiment with a central plate and with at least one donut of a second elastic material being arranged between the central plate and an end plate of the housing, a adjustable stopper is provided that determines, how far the central pin reaches through a hole that in a preferred embodiment is provided in the end plate of the housing. The further the central pin reaches through the end plate, the more the donut arranged between the central plate and the end plate needs to be compressed. The stopper thus is a means of defining the pre-load on the donut.

In a preferred embodiment, the housing has the shape of a hollow cylinder with the elastic deformation element being arranged inside the hollow cylinder. Such an arrangement protects the elastic deformation elements.

In a preferred embodiment the end plate of the housing rests against an inward pointing rim on one side of the housing, whereby the end of the fastener is connected to the opposite end of the housing. Such an arrangement will lead to a redirection of the flow of force through about 180 degrees, if a pushing force is applied to the holder. The pushing force will push the holder towards the housing. The central plate arranged on the central pin will push the elastic deformation elements arranged between the central plate and the end plate of the housing towards the end plate of the housing and will thereby press the end plate of the housing towards the inward pointing rim at one end of the housing. If the fastener according to the invention is now connected to the opposite end of the housing, the pushing force applied to the holder and hence applied to the inward pointing rim at the end of the housing will tend to move the housing in the direction of the pushing force. This will lead to tendency to move the end of the fastener in the direction of the pulling force and hence also the head of the fastener in the direction of the pushing force. This will lead to the head of the fastener being pressed against the first end of the deformation tube. This will lead to the second end of the deformation tube being pressed against a surface of the car or a connection plate suitable to be connected to the car arranged at the opposite end of the housing. This allows for a space efficient design of the pivot anchor. Usually, cars of a multi-car vehicle have a certain freedom in the underbody of the car. Hence, the housing and the elastic deformation elements can be arranged in the underbody of the car, allowing the holder and the pivot pin to be arranged closely to the point where the second end of the deformation tube rests against a surface of the car or rests against a connection plate suitable to be connected to the car.

In a preferred embodiment, the pivot anchor according to the invention has a connection plate that is suitable to be connected to a multi-car vehicle, whereby the connection plate has at least one hole whereby the fastener passes through the hole and fastens the housing to the connection plate, the connection plate being arranged between the second end of the deformation tube and an end-surface of the housing.

In a preferred embodiment, the pivot anchor has a multitude of holes and a multitude of fasteners, whereby each fastener passes through one of the holes and fastens the housing to the connection plate, the connection plate being arranged between the second ends of the deformation tubes and an end-surface of the housing.

In a preferred embodiment, the fasteners are arranged in a ring. It is especially preferred that the pivot pin is arranged inside the ring, when looking at the pivot anchor from the front.

The car according to the invention has a pivot anchor according to the invention.

In the method of attaching a pivot anchor according to the invention to a car of the invention the fastener of an energy absorbing fastener according to the invention connected to an element of the pivot anchor in such a manner, that the head of the fastener rests against the first end or rests against an element that rests against the first end, and the second end of the deformation tube rests against a surface of the car or a connection plate suitable to be connected to the car. This allows for an easy way to exchange deformation tubes of a connection device, if these have become worn or weakened during normal use or have even become deformed during a collision.

BRIEF DESCRIPTION OF THE SEVERAL VIEWS OF THE DRAWINGS

In the following an embodiment of the invention will be described by use of the following FIGS.

DETAILED DESCRIPTION OF THE INVENTION

Figure 1:
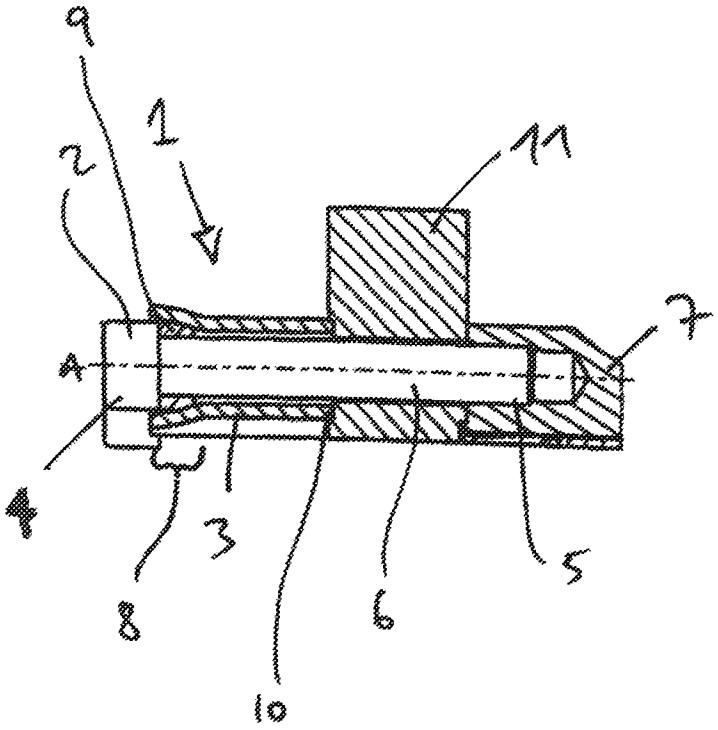
FIG. 1 A cross sectional of the view of the energy absorbing fastener according to the invention.

FIG. 1 shows an energy absorbing fastener 1. The energy absorbing fastener consists of a fastener 2 and a deformation tube 3 that surrounds the fastener 2. The fastener 2 has a head 4 and an end 5. Between the head 4 and the end 5 a main body 6 is provided for the fastener 2. The end 5 has a male thread and therefore is suitable to be connected to an element of the coupler or pivot, namely a part of a housing 7 of a pivot anchor that has a hole with a female thread. The deformation tube has a first end 8. The diameter of the deformation tube 3 widens within the first end 8. The deformation tube 3 has a second end 10 that is suitable to rest against a surface of a car or a connection plate 11 suitable to be connected to the car. The deformation tube at its second end 10 has a ring-shaped end surface, whereby the ring-shaped end surface lies in a plane that is perpendicular to the longitudinal axis (a) of the deformation tube. This plane, ring-shaped end surface makes the deformation tube 3 suitable to rest against a surface of a connection plate 11.

A conical ring is provided, that forms an element 9 that rests against the first end 8. The conical ring is inserted into the first end 8 of the deformation tube 3, whereby the conical ring contacts the inner walls of the deformation tube 3. The head 4 of the fastener 2 rests against the conical ring.

Figure 3:
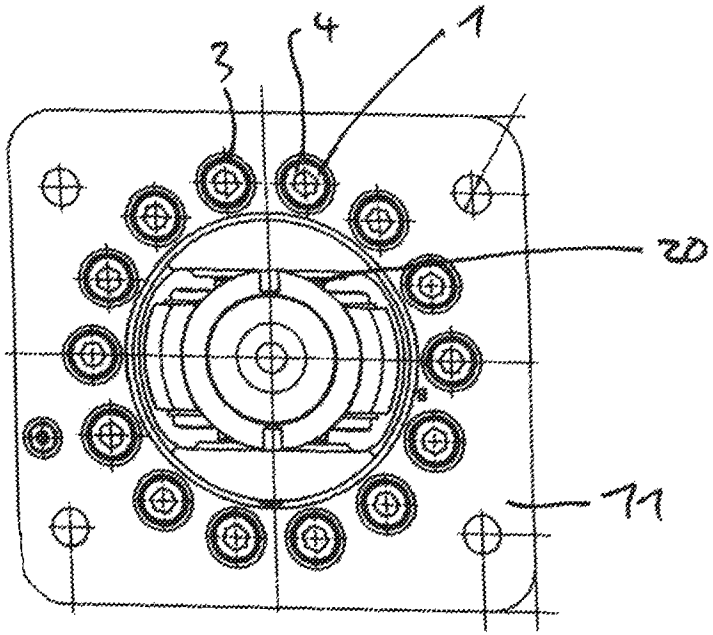
FIG. 3 a front view onto a pivot anchor according to the invention.
Figure 2:
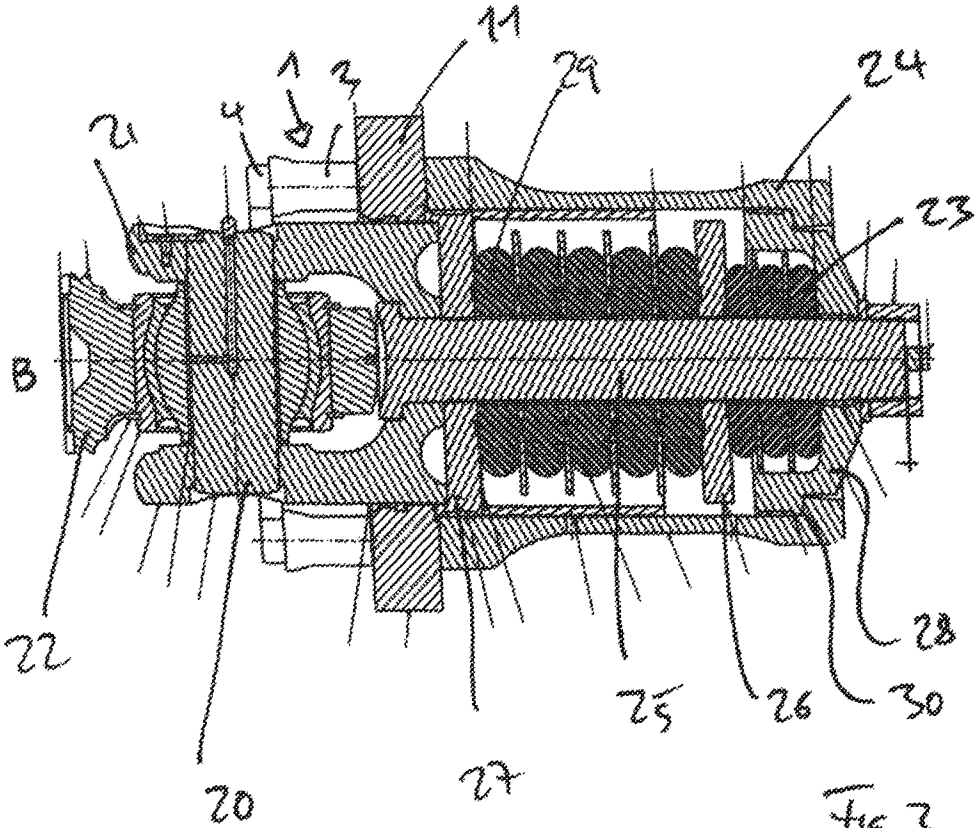
FIG. 2 a cross sectional view of a pivot anchor according to invention.

FIGS. 2 and 3 show a pivot anchor for a car of a multi-car vehicle. The pivot anchor has a pivot pin 20 that is held in a holder 21. Attached to the pivot 20 is an element, for example a connection bar 22, which allows to connect two cars of a multi-car vehicle. The connection bar can for example carry a coupler head (not shown) or can be directly coupled to the next car, especially preferred to a pivot pin of a pivot anchor provided at the next car. The pivot pin 20 allows the connection bar 22 to pivot relative to the holder 21.

The pivot anchor according to the invention further has three elastic deformation elements 23, arranged between the holder 21 and a housing 24. The elastic deformation elements 23 are compressed, when the holder 21 is moved towards the housing (from the left towards the right in FIG. 2). Such a movement might occur, if an axial force acting along the longitudinal axis be of the pivot anchor is applied to the connection bar 22 that acts from the left towards the right in FIG. 2.

A pivot anchor according to the invention has fourteen fasteners according to the invention. The fourteen fasteners according to the invention are connected to the housing 24 by the end 5 of the respective fastener 2 being attached to the housing 24. The fasteners 1 according to the invention are arranged in a ring (see FIG. 3). The pivot pin 20 is arranged inside the ring when looking at the pivot anchor according to the invention from the front (FIG. 3).

The three elastic deformation elements 23 consist of donuts made from an elastic material.

A central pin 25 is attached to the holder 21. The central pin is inserted into the central opening of the donuts that make up the elastic deformation elements 23.

A central plate 26 is arranged on the central pin 25. At least one donut 29 from a first elastic material is arranged between a front plate 27 of the housing. The front plate 27 of the housing 24 has a central opening, through which the central pin 25 passes. At least one donut of a second elastic material, namely the three donuts of the elastic deformation element 23 are arranged between the central plate 26 and an end plate 28 of the housing 24.

The housing 24 has the shape of a hollow cylinder with the elastic deformation elements being arranged inside this hollow cylinder.

The end plate 28 of the housing 24 rests against an invert pointing rim 30 on one end of the housing 24. The end 5 of the fastener 2 is connected to the opposite end if the housing 24.

The pivot anchor according to the invention has a connection plate 11 that is suitable to be connected to a car of a multi-car vehicle. For this purpose, the connection plate 11 has four holes 31. Through these four holes, screws can be passed, which allow the connection plate to be screwed to the underframe of a car. The connection plate 11 has fourteen further holes. A respective fastener 2 passes through the respective hole and fastens the housing 24 to the connection plate 11, the connection plate 11 being arranged between the second end 10 of the deformation tube 3 and the end-surface of the housing 24.

The invention claimed is:

1. An energy absorbing fastener suitable for connecting a part of a coupler or pivot to a car of a multi-car vehicle, characterized by a fastener having a head and an end, the end being suitable to be connected to an element of the coupler or the pivot, a deformation tube surrounding the fastener, whereby the deformation tube has a first end, whereby the head of the fastener rests against the first end or rests against an element that rests against the first end, and whereby the deformation tube has a second end suitable to rest against: (i) a surface of the car or (ii) a connection plate suitable to be connected to the car, wherein the end of the fastener extends past the second end of the deformation tube to permit the end of the fastener to be received in a hole in the surface of the car or the connection plate while the second end of the deformation tube rests against the surface of the car or the connection plate.

2. Fastener according to claim 1 characterized in that the end of the fastener has a thread.

3. The fastener according to claim 1, characterized in that the diameter of the deformation tube widens at the first end.

4. The fastener according to claim 1, characterized by a conical ring inserted into the first end of the deformation tube, whereby the conical ring contacts the inner walls of the deformation tube and the head of the fastener rests against the conical ring.

5. The fastener according to claim 2, characterized in that the diameter of the deformation tube widens at the first end.

6. The fastener according to claim 2, characterized by a conical ring inserted into the first end of the deformation tube, whereby the conical ring contacts the inner walls of the deformation tube and the head of the fastener rests against the conical ring.

7. The fastener according to claim 3, characterized by a conical ring inserted into the first end of the deformation tube, whereby the conical ring contacts the inner walls of the deformation tube and the head of the fastener rests against the conical ring.

8. A pivot anchor for a car of a multi-car vehicle having a pivot pin held in holder, an elastic deformation element arranged between holder and a housing, the elastic deformation element being compressed when the holder is moved towards the housing, wherein an energy absorbing fastener comprising a fastener having a head and an end, the end being suitable to be connected to an element of a coupler or a pivot, and a deformation tube surrounding the fastener is connected to the housing by the end of the fastener being attached to the housing.

9. The pivot anchor according to claim 8, characterized in that the elastic deformation element consist of at least one donut made from an elastic material.

10. The pivot anchor according to claim 9, characterized in that a central pin is attached to the holder and in that the central pin is inserted into the central opening of the donut.

11. The pivot anchor according to claim 10, characterized in that a central plate is arranged on the central pin and in that at least one donut from a first elastic material is arranged between a front plate of the housing and the central plate and in that at least one donut of a second elastic material is arranged between the central plate and an end plate of the housing.

12. The pivot anchor according to claim 11, characterized in that the end plate of the housing pin rests against an inward pointing rim on one end of the housing and whereby the end of the fastener is connected to the opposite end of the housing.

13. The pivot anchor according to claim 9, characterized in that the housing has the shape of a hollow cylinder with the elastic deformation element arranged inside the hollow cylinder.

14. The pivot anchor according to claim 9, characterized by a connection plate suitable to be connected to a car of a multi-car vehicle, whereby the connection plate has at least one hole, the fastener passes through the hole and fastens the housing to the connection plate, the connection plate being arranged between the second end of the deformation tube and an end-surface of the housing.

15. The pivot anchor according to claim 8, characterized in that the housing has the shape of a hollow cylinder with the elastic deformation element arranged inside the hollow cylinder.

16. The pivot anchor according to claim 15, characterized in that the end plate of the housing pin rests against an inward pointing rim on one end of the housing and whereby the end of the fastener is connected to the opposite end of the housing.

17. The pivot anchor according to claim 8, characterized by a connection plate suitable to be connected to a car of a multi-car vehicle, whereby the connection plate has at least one hole, the fastener passes through the hole and fastens the housing to the connection plate, the connection plate being arranged between the second end of the deformation tube and an end-surface of the housing.

18. The pivot anchor according to claim 17, characterized by a multitude of holes and a multitude of fasteners, whereby each fastener passes through one of the holes and fastens the housing to the connection plate, the connection plate being arranged between the second ends of the deformation tubes and an end-surface of the housing.

19. The pivot car of a multi-car vehicle with a pivot anchor according to claim 8.

20. A method of attaching a pivot anchor to a car, comprising:

connecting an element of the pivot anchor to an energy absorbing fastener comprising a fastener having a head and an end, the end being suitable to be connected to an element of a coupler or a pivot and a deformation tube having a first end and a second end surrounding the fastener, such that the head of the fastener rests against the first end of the deformation tube or rests against an element that rests against the first end of the deformation tube, and the second end of the deformation tube rests against a surface of the car or a connection plate suitable to be connected to the car.

* * * * *